US005524756A

United States Patent [19]

Sutherland

[11] Patent Number: 5,524,756

[45] Date of Patent: Jun. 11, 1996

[54] WRAP-AROUND CARRIER WITH ARTICLE RETAINING FLAPS

[75] Inventor: Robert L. Sutherland, Kennesaw, Ga.

[73] Assignee: Riverwood International Corporation, Atlanta, Ga.

[21] Appl. No.: 445,063

[22] Filed: May 19, 1995

[51] Int. Cl.[6] ..... B65D 75/00

[52] U.S. Cl. ..... 206/434; 206/140; 206/152; 206/427

[58] Field of Search ..... 206/140, 147, 206/152, 155, 427, 429, 434

[56] References Cited

U.S. PATENT DOCUMENTS

| | | | |
|---|---|---|---|
| 3,229,892 | 1/1966 | Weiss | 206/152 |
| 3,367,557 | 2/1968 | Farquhar | 206/434 |
| 3,517,876 | 6/1970 | Stout | 206/434 |
| 4,355,717 | 10/1982 | Oliff | 206/140 |
| 4,533,047 | 8/1985 | Calvert | 206/434 |
| 4,545,485 | 10/1985 | Oliff | 206/147 |
| 5,094,347 | 3/1992 | Schuster | 206/140 |

FOREIGN PATENT DOCUMENTS

| | | | |
|---|---|---|---|
| 4025363 | 11/1994 | WIPO | 206/427 |

*Primary Examiner*—David T. Fidei

[57] ABSTRACT

A wrap-around carrier for packaging articles such as beverage bottles or cans. Inwardly folded retaining flaps are connected to the side edges of apertures through which the lower portions of the articles protrude. The fold lines of the flaps are arranged to create a bias tending to maintain pressure on the articles to prevent movement within the carrier. The flaps are connected by fold lines to the side panels and to the bottom panel, but are unconnected to heel panels extending between the side and bottom panels. The flaps adjacent the heel panel portions of the aperture edge act as a stop, preventing tearing of the aperture. Additionally, the fold lines connecting the heel panels to the side and bottom panels are half-score lines.

5 Claims, 3 Drawing Sheets

WRAP-AROUND CARRIER WITH ARTICLE RETAINING FLAPS

FIELD OF THE INVENTION

This invention relates to wrap-around carriers which contain heel cutouts or apertures for holding the bottom portions of adjacent articles in place. More particularly, it relates to a wrap-around carrier provided with additional retaining means for securing the articles in the carrier.

BACKGROUND OF THE INVENTION

When forming a wrap-around carrier package the carrier blank is tightly drawn about the articles to be packaged in order to hold the articles in place and prevent them from moving toward the open ends of the carrier during shipment and handling. To further ensure a secure package, carriers designed to accommodate beverage bottles are normally provided with cutouts in the side panels which allow the bottom or heel portion of the bottles to extend out beyond the side panel. As a result, the bottles are additionally held in place by the bite between their bottom portions and the side edges of the cutouts. Despite the success of such carriers it is desirable to provide even greater restriction to bottle movement, especially in wrap-around carriers used for packaging relatively large bottles or bottles whose bottom portions are not of a constant diameter.

It has been suggested to connect bottle retaining flaps to the side edges of the heel cutouts so that when the wrapper is folded into place, the retaining flaps open, or fold in, engaging the bottom portion of the bottles. While such designs have resulted in adding additional restraint against bottle movement, it would be desirable to provide greater resistance to tearing at the heel cutout edges and to strengthen the area between cutouts.

A main object of this invention, therefore, is to provide a wrap-around carrier having improved article retaining flaps which result in greater strength in the edges of the cutouts and in the area between cutouts. Such a design must not interfere with the folding of the carrier wrap or the inward folding of the retaining flaps.

BRIEF SUMMARY OF THE INVENTION

The wrap-around carrier of the invention is designed to carry a plurality of articles having lower side portions which are aligned with heel cutouts in the carrier. The heel cutouts are apertures having opposite side edges which extend through adjacent portions of the side panels, the heel panels and the bottom panel of the carrier. Article retaining flaps extend inwardly from the side edges of the apertures and contact the lower side portion of the articles to assist in holding them against movement within the carrier. The retaining flaps are connected by fold lines to the side panel and to the bottom panel, and each retaining flap has an unconnected edge adjacent the portion of the aperture which extends through the heel panel. When the retaining flaps are in folded, operative condition, the portion of the flaps adjacent the unconnected edge acts as a stop to the adjacent outer edge of the heel cutout aperture, providing additional tear resistance in this area.

A transverse fold line extending across the retaining flaps from a point on their unconnected edge may be provided to better enable the flaps to fold or flex as needed during carrier formation. In addition, each heel panel is foldably connected to the side panel and to the bottom panel by score lines which preferably are comprised of half-creases. Such score lines are comprised of depressions in the outer surface of the carrier and an opposite bulge in the inner surface of the carrier, arranged so that the depression extends a greater distance inward than the bulge extends outward. This strengthens the structure and promotes concurrent folding about the score lines to better provide for automatic opening of the retaining flaps without the need for any mechanical manipulation.

The carrier of the invention reliably prevents outward movement of packaged articles, including curved articles such as beverage bottles or cans, and does so in an improved, efficient manner.

The above and other aspects and benefits of the invention will readily be apparent from the more detailed description of the preferred embodiment of the invention which follows.

DETAILED DESCRIPTION OF THE PREFERRED EMBODIMENT

Figure 1:
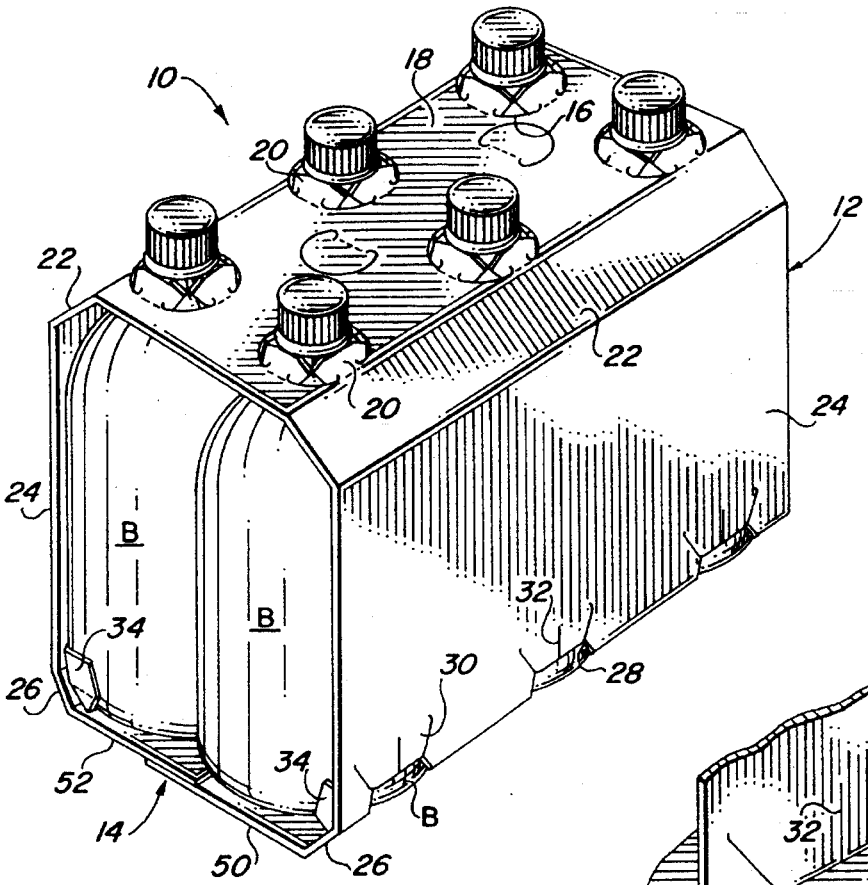
FIG. 1 is a pictorial view of the wrap-around carrier of the invention.

Referring to FIG. 1, a package 10 is comprised of wrap-around carrier 12 containing six beverage bottles B supported on bottom panel 14. The necks of the bottles extend up through openings 16 in top panel 18 and neck retaining tabs 20, which are foldably connected to the top panel, engage flanges on the bottle necks. Sloped shoulder panels 22 connect the top panel 18 to side panels 24. Although the sloped shoulder panels enable the carrier wrapper to more closely follow the contour of the upper portion of the illustrated bottles, they are not directly related to the invention and may or may not be present depending on the shape of the packaged articles. The side panels 24 are connected at their lower end to short sloped heel panels 26 which are connected to the bottom panel 14. Cutouts 28 in the side panels 24 and in the heel panels 26 receive protruding heel portions of the bottles. Tabs 30, which include vertical slits 32 in their lower edge portions, extend down from the side panels 24 and contact the outer heel portions of the bottles.

Figure 3:
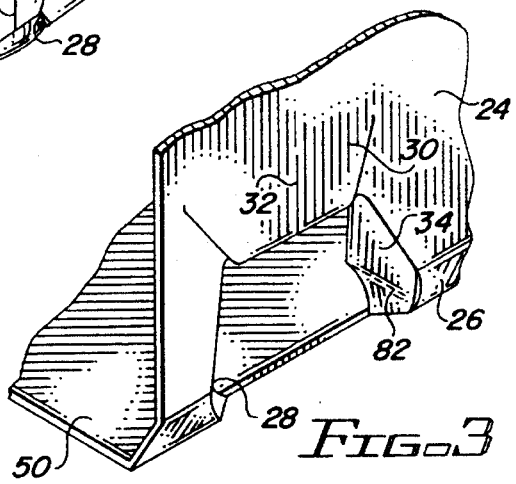
FIG. 3 is an enlarged partial pictorial view of an end of the carrier of FIG. 1, with the end bottle omitted for clarity.
Figure 2:
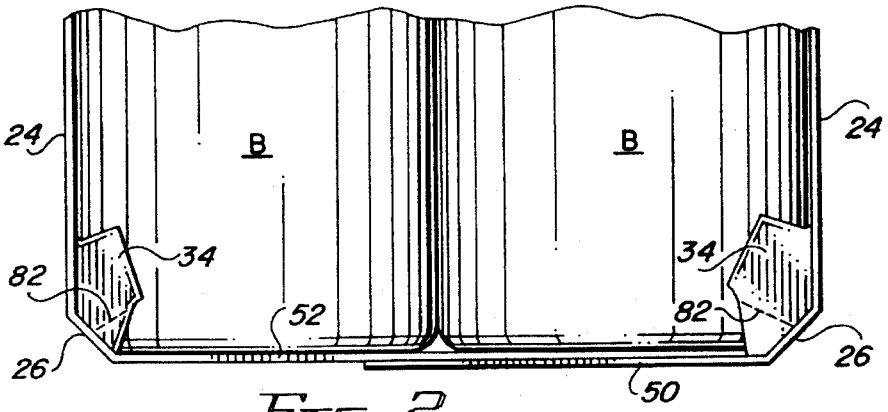
FIG. 2 is an enlarged partial end view of the carrier of FIG. 1.

As shown in FIGS. 1 and 2, retaining flaps 34 extend inwardly from the outer side edge of the end cutouts and are in contact with the heel portion of the adjacent bottle. Similar retaining flaps extend back from opposite side edges of all the cutouts, as illustrated in FIG. 3, which does not show the associated bottle in order to expose the inner flap to view. Due to the foldable connections between the flaps and the cutout edges, which are described in more detail below, the flaps are biased toward the bottles so as to maintain continuous contact with the bottles.

Figure 4:
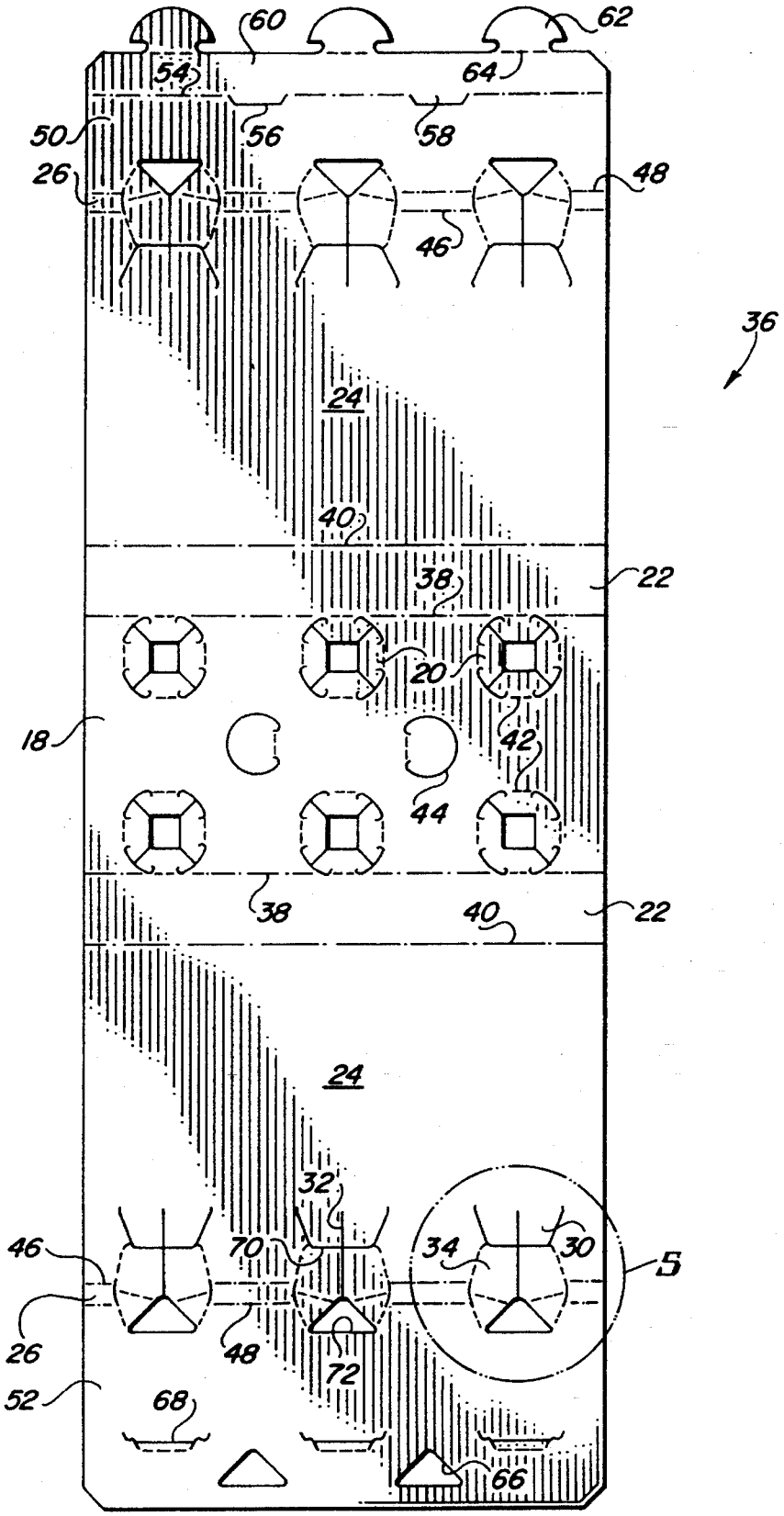
FIG. 4 is a plan view of a blank for forming the carrier of FIG. 1.

Referring now to FIG. 4, wherein like reference numerals to those used in FIGS. 1, 2 and 3 denote like elements, a substantially rectangular blank 36 capable of being fabricated into the carrier of FIG. 1 is comprised of a central top panel section 18 connected at opposite sides by fold lines 38 to the shoulder panel sections 18. Fold lines 40 connect the shoulder panel sections 18 to side panel sections 24. The bottle neck retainer tabs 20 are connected by fold lines 42 about the edge of the finger holes and are adapted to be folded up by the bottle necks as they move through the openings during formation of the package. If the articles to be packaged do not have necks or are otherwise shaped so as not to extend through the top panel, the openings 14 would of course not be provided. In addition, finger holes 44 are provided in the top panel section 18 for lifting the carrier.

Interrupted score lines 46 connect the side panel sections 24 to the heel panel sections 26, while interrupted score lines 48 connect the heel panel sections 26 to bottom panel flaps 50 and 52. The fold lines 46 and 48 are parallel to each other. Included in the bottom panel flap 50 is a fold line 54 which extends the full length of the flap and which is interrupted by slits 56 forming primary male locking tabs 58. The portion 60 of the flap 50 lying outwardly of the fold line 54 constitutes a locking panel which includes secondary male locking tabs 62 connected to the locking panel by fold lines 64. Incorporated in the bottom panel flap 52 are cutouts 66, which include primary female locking edges for engaging the primary male locking members 58, and slits 68 adapted to receive the secondary locking tabs 62. These various locking elements are illustrated to demonstrate a typical bottom panel locking arrangement suitable for use with the carrier of the invention, but it should be understood that any desired effective form of bottom panel locking means may be employed.

Figure 5:
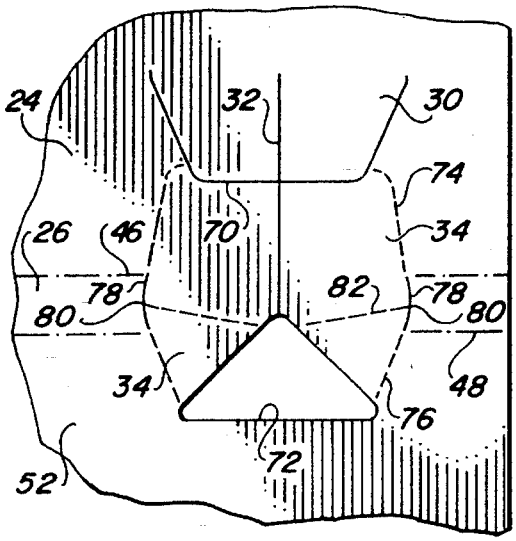
FIG. 5 is an enlarged plan view of the area within the circle 5 of FIG. 4.

Referring to FIGS. 4 and 5, each heel cutout comprises an aperture defined at the top by the lower portion of the slit 70 which forms the associated tab 30, at the bottom by the edge 72 of the associated bottom panel flap 50 or 52 and at the sides by the fold lines 74 and 76 and the slits 78. The fold line 74, which connects each retaining flap 34 to the side panel section 24, and the fold line 76, which connects each retaining flap to the bottom panel flap 50 or 52, form portions of the aperture edges, extending along converging paths and terminating at the score lines 46 and 48, respectively. A slit 78 connects the fold lines 74 and 76. Segments of the slit extend along the same paths as fold lines 74 and 76, converging toward each other and meeting at a point 80. The distance between the slits 78 of opposite edges of a cutout is the greatest between the points 80, thus making the slits inwardly concave. Extending across each retaining flap 34 from the point 80 is a fold line 82.

A package is formed from the carrier blank by grouping the bottles as they are to be arranged in the package and then placing the top panel section 16 of the blank on top of the bottles, with the necks of the bottles aligned with the bottle neck openings 14. The blank is then pushed down so that the bottle necks protrude through the bottle neck openings and the side panel sections 24 are folded along the fold lines 38. While the blank is being folded down, inward folding of the retaining flaps 34 is initiated so that each pair of flaps is positioned on opposite sides of an associated bottle. As the blank is pulled tightly around the bottles, folding of the retaining flaps automatically continues as a result of the pressures caused by the folding of the bottom panel flaps. The bottom panel flaps are then locked together by the locking tabs to form the bottom panel 12. Because the retaining flaps are folded about the angled fold lines 74 and 76, a bias is created tending to return the retaining flaps to their original position. This causes them to maintain a steady pressure against an adjacent bottle, assisting to hold the bottle in place. The internal fold line 82 takes up the stresses in the flaps which would otherwise cause the flaps to buckle as they are folded in against the bias of the fold lines 74 and 76.

As can be seen in FIGS. 1, 3, 4 and 5, the upwardly extending portions of the slits 70 forming the side edges of the tabs 30 extend up into the side panel sections 24, allowing the tabs to be pushed out to an extent, against the bias tending to keep them in the plane of the side panel, by an associated bottle. The slits 32 divide the tabs in two, facilitating such tab movement. The tabs 30 thus also exert an inward force against the bottles to help maintain them in place in the carrier. Because the design permits similar retaining flaps to be provided at opposite edges of each heel cutout, each bottle in the carrier is subjected to equal amounts of retaining forces on both sides.

Figure 6:
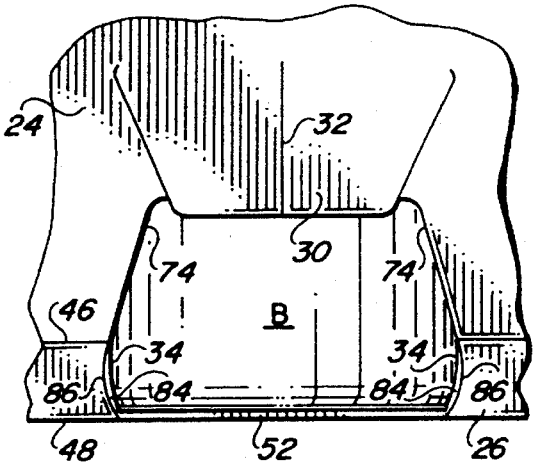
FIG. 6 is an enlarged partial side view of the carrier showing one of the heel cutout areas.

As indicated, when the retaining flaps 34 move into place they fold inwardly about the fold lines 74 and 76. Since the retaining flaps are not connected to the carrier between the score lines 46 and 48, the edges of the folded flaps corresponding to the slits 78 are not connected to the corresponding edges of the heel cutout aperture. As illustrated best in FIGS. 3 and 6, when the retaining flaps 34 are in their final folded condition the edges 84 of the folded flaps formed by the slits 78 face outward, adjacent to the edge 86 of the aperture. The adjacent face of the flap 34 is therefore in substantial contact with the aperture edge 86. As a result of this relationship, the flaps act as stops against the edges 86, increasing the resistance to tear-out of the aperture edges. This phenomenon is accentuated by the nonlinear path of the slits 78, which causes the edges 84 of the folded flaps 34 to contact the carrier panel adjacent the heel cutouts with greater force, thereby increasing the stopping or buttressing effect.

Preferably, the score lines 46 and 48 are formed as half-score lines rather than full score lines. Scoring of paperboard or other fibrous sheet material is conventionally carried out by striking one face of the sheet with die rules which move through slots in a die board. The die board functions as a support on which the material rests. A counterboard in contact with the opposite face of the sheet holds the sheet in place. When a die rule strikes the sheet it produces an indentation in the face of the sheet which it contacts and a corresponding outward bulge in the opposite face. A gap in the counterboard opposite the slot in the support allows the bulge to form.

Figure 7:
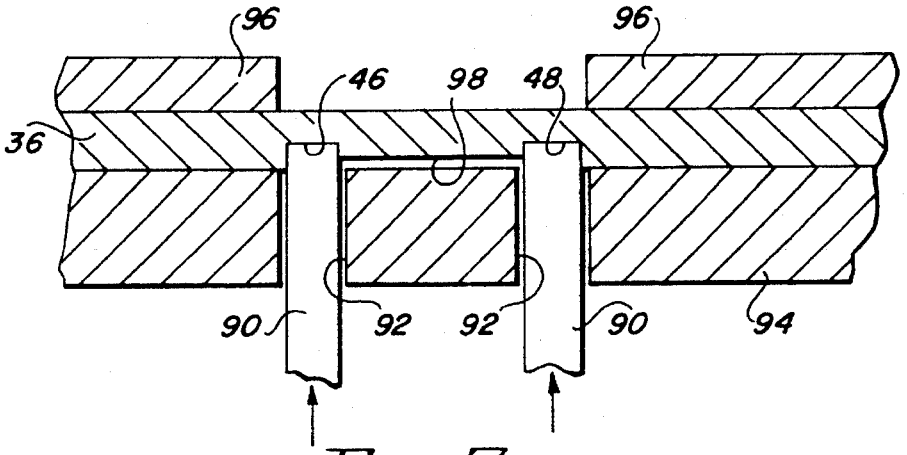
FIG. 7 is an enlarged partial transverse sectional view of a die rule arrangement for producing a preferred type of score line in the carrier blank.
Figure 8:
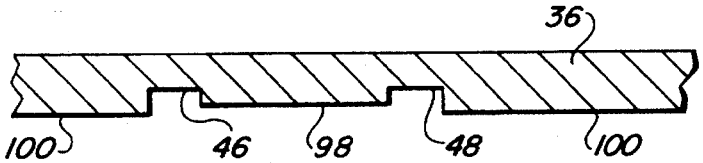
FIG. 8 is an enlarged partial transverse sectional view of a portion of a blank which has been scored by the die arrangement of FIG. 7.

The two half-crease score lines 46 and 48 are formed by removing the portions of the counterboard between the gaps. As shown in FIG. 7, die rules 90 move up through slots 92 in the die board 94 to contact the blank 36 and form score lines. Because the portion of the counterboard 96 between the outer edges of the die rules has been removed, a greater expanse of the opposite blank surface can absorb the force of the die rules so that typical corresponding bulges are not formed in the upper surface of the blank 36, with only minor, if any, displacement occurring. The impact of the die rules also compresses and displaces the lower surface of the paperboard between the creases 46 and 48, although to a substantially lesser degree. This is illustrated in FIG. 8, which shows the scores or creases 46 and 48 extending into the blank for a short distance, typically an amount less than half the thickness of the blank, and the intermediate face 98 between the scores being slightly compressed from the underside 100 of the sheet.

The use of half-crease score lines to form the sloped heel panels is beneficial. The edges of the heel cutout apertures between the score lines are made more resistant to tearing as a result of the compression of the portion 98, thereby strengthening the portions of the carrier between the heel cutouts. Further, the presence of a slightly compressed portion between the half-crease score lines makes the entire area from score line to score line behave as a single wide score, offering somewhat more resistance to folding of the blank. For example, while a conventional score line can be folded a substantial amount, the normal range for folds between the surfaces 98 and 100 of the blank is 30°–40°. Although this added resistance to folding is not enough to cause problems in carrier formation, it acts to more positively fold the retaining flaps toward the interior of the carrier during carrier formation. Also, the greater resistance of a half-crease score line to tearing decreases the danger of tearing at the ends of the slits 78.

The carrier should be formed of a material which is sufficiently flexible to permit folding into final form and to provide the biasing properties required of the flap fold lines. In addition, the material must be capable of being compressed so that the scores can be formed. Paperboard of the type typically employed in the carrier industry is the preferred choice, since it is economical, readily foldable, and capable of readily causing the retaining flap fold lines to be sufficiently biased toward the interior of the package. It also is suitably compressible to permit ready formation of the half-crease score lines described above.

It should now be apparent that the invention provides improved article retaining means in a wrap-around carrier in an economical efficient manner. Although described in connection with the packaging of beverage bottles, it will be appreciated that other articles, such as cans, can also be packaged in carriers incorporating the features of the invention. Also, although it is preferred that heel apertures with identical retaining flaps be provided at all article locations, obviously retaining flaps may be selectively provided on only certain apertures if desired. Further, it is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A wrap-around carrier containing a plurality of articles having lower side portions, comprising:

opposite side panels, each side panel being foldably connected to a top panel and to a sloped heel panel;

each heel panel being foldably connected to a bottom panel;

the carrier including an aperture located opposite the lower side portion of at least some of the articles, each aperture including opposite side edges extending through adjacent portions of the associated side panel, the associated heel panel and the bottom panel;

article retaining flaps extending inwardly from the side edges of the apertures and contacting the lower side portion of an associated article, each retaining flap being connected by a fold line to the associated side panel and to the bottom panel; and each retaining flap having an unconnected edge adjacent the side edge of the aperture extending through the heel panel;

each heel panel being foldably connected to the associated side panel and to the bottom panel by score lines each of which is comprised of a depression in the outer surface of the carrier, the heel panels having a thickness less than the thickness of the side panels and bottom panel.

2. A substantially rectangular blank for forming a wrap-around carrier for use in packaging articles having lower side portions, comprising:

a centrally located top panel section;

side panel sections connected to opposite sides of the top panel section along fold lines;

each side panel section connected by a score line to a heel panel section;

each heel panel section connected by a score line to a bottom panel flap at each end of the blank;

the blank including a plurality of apertures, each aperture located opposite the intended location of the lower side portion of an article in a carrier formed from the blank;

each aperture having opposite edges extending through adjacent portions of the associated side panel section, the associated heel panel section and the associated bottom panel flap;

an article retaining flap connected to each opposite edge of the apertures, the flap being connected by a fold line to the portion of the aperture edge extending through the associated side panel section and by a fold line to the portion of the aperture edge extending through the associated bottom panel flap; and each retaining flap having an unconnected edge adjacent the portion of the aperture edge extending through the associated heel panel section;

the heel panel score lines extending into the blank for a substantial distance, the surface of the blank opposite the heel panel score lines having little or no corresponding outward bulge and the thickness of the heel panel section being less than the thickness of the side panel section and the thickness of the bottom panel flaps.

3. In a wrap-around carrier having sloped heel panels connected to side panels and to a bottom panel along score lines, the improvement comprising:

forming the carrier from a blank having heel panel sections connected to associated side panel sections and associated bottom panel flaps by score lines which extend inwardly from the outer face of the blank a substantial distance;

the inner face of the blank containing little or no bulge opposite the score lines, and the thickness of the heel panel sections being slightly less than the thickness of the side panel sections and the bottom panel flaps.

4. An improved wrap-around carrier as defined in claim 3, wherein the outer face of the side panel sections and the bottom panel flaps of the blank lie in substantially a common plane, the outer face of the heel panel sections lying in a plane slightly inwardly spaced from said common plane.

5. An improved wrap-around carrier as defined in claim 4, wherein the blank is comprised of fibrous paperboard, the paperboard being compressed to a relatively great extent in the areas of the heel panel score lines and to a relatively small extent in the heel panel sections between the score lines.

* * * * *